US009228347B2

(12) United States Patent
Underkofler et al.

(10) Patent No.: US 9,228,347 B2
(45) Date of Patent: Jan. 5, 2016

(54) TORSION SPRING METAL CEILING SYSTEM AND HARDWARE

(71) Applicant: USG Interiors, LLC, Chicago, IL (US)

(72) Inventors: Abraham M. Underkofler, Waukegan, IL (US); Peder J. Gulbrandsen, Aurora, IL (US); Mark R. Paulsen, Waukegan, IL (US)

(73) Assignee: USG INTERIORS, LLC, Chicago, IL (US)

( * ) Notice: Subject to any disclaimer, the term of this patent is extended or adjusted under 35 U.S.C. 154(b) by 0 days.

(21) Appl. No.: 14/291,056

(22) Filed: May 30, 2014

(65) Prior Publication Data

US 2015/0345139 A1 Dec. 3, 2015

(51) Int. Cl.
*E04B 9/00* (2006.01)
*E04B 9/04* (2006.01)

(52) U.S. Cl.
CPC ..... *E04B 9/003* (2013.01); *E04B 9/0435* (2013.01)

(58) Field of Classification Search
CPC ..... E04B 9/003; E04B 9/0435; E04B 9/0478; E04B 9/225; E04B 9/18; E04B 9/26; E04B 9/28
USPC ..... 52/506.06–506.1
See application file for complete search history.

(56) References Cited

U.S. PATENT DOCUMENTS 3,303,338 A * 2/1967 Lyon ..... 362/148
4,189,893 A * 2/1980 Kuhr ..... 52/506.07
4,438,613 A * 3/1984 Hintsa et al. ..... 52/506.09
4,548,010 A * 10/1985 Hintsa ..... 52/506.09
5,428,930 A * 7/1995 Bagley et al. ..... 52/506.07
6,971,210 B2 * 12/2005 Kliegle et al. ..... 52/506.07
7,076,928 B2 * 7/2006 Kliegle et al. ..... 52/506.09
7,841,149 B2 * 11/2010 Jahn et al. ..... 52/506.08
7,909,297 B1 3/2011 Harris et al.
8,316,607 B2 * 11/2012 Eisner et al. ..... 52/506.09
8,683,768 B2 * 4/2014 Gerkes et al. ..... 52/506.08
2004/0118068 A1 * 6/2004 Kliegle et al. ..... 52/483.1
2007/0193131 A1 * 8/2007 Ortiz ..... 52/144
2012/0023853 A1 * 2/2012 Gerkes et al. ..... 52/506.06

OTHER PUBLICATIONS

Armstrong Metalworks Torsion Spring brochure, 5 pages, © 2013 AWI Licensing Company.
Chicago Metallic, SpanAir Metal Ceiling Systems Product Guide, 16 pages, © 2011 Chicago Metallic Corporation.
Decoustics Limited, Ceilencio Ceiling Suspension System brochure, 3 pages, © Feb. 2013 Decoustics Limited.
(Continued)

*Primary Examiner* — Joshua J Michener
*Assistant Examiner* — Theodore Adamos
(74) *Attorney, Agent, or Firm* — Pearne & Gordon LLP

(57) ABSTRACT

A rectangular panel for a suspended ceiling, the panel having a suspension spring with two divergent arms at each of two opposed panel edges mounted on a rear side of the panel, each spring being mounted on the panel in an arrangement permitting the arms to lie parallel to a front face of a panel, project rearwardly perpendicular to the front face and to lie outside of the panel parallel to the front face, the spring mounting arrangement enabling the spring to be maintained in the rearward orientation by a force developed by the spring with its arms confined and locator elements for registering the panel with grid members of the ceiling.

7 Claims, 4 Drawing Sheets

(56) References Cited

OTHER PUBLICATIONS

Hunter Douglas Architectural Products, Inc., LUXALON, Torsion Spring System—Instruction Sheet, dated May 29, 2013 (or earlier).

International Search Report and Written Opinion of the International Searching Authority dated Aug. 10, 2015 for PCT/US2015/031525, filed May 19, 2015.

* cited by examiner

TORSION SPRING METAL CEILING SYSTEM AND HARDWARE

BACKGROUND OF THE INVENTION

The invention relates to downwardly accessible suspended ceiling panels.

PRIOR ART

One type of suspended ceiling system comprises a grid and panels that rely on springs to hold the panels vertically against the underside of the grid elements. Ordinarily, springs are provided on opposite edges of the panels. Springs can be of the torsion type having a pair of arms extending from a central coil. In a free state, the arms are widely divergent so that when confined by slots or stops at the plane of the grid, the arms draw the panel upwardly against the grid.

It is known to attach the springs in a manner that enables the arms to lie flat against a rear face of the panel for shipping purposes and to extend laterally outwardly from the panel. This latter orientation allows the panel to hang from the grid by the spring arms at one side for convenience when accessing the plenum above the ceiling.

Generally, it has been difficult to quickly and precisely position spring mounted panels on the overlying grid with the result that the joints between the panels are often noticeably irregular. This poor registration can be the result of reliance on the suspension springs to locate a panel in the horizontal plane both laterally and longitudinally.

SUMMARY OF THE INVENTION

The invention is embodied in a novel multi-function clip that attaches a suspension spring to the ceiling panel. The clip enables the spring to hinge through 180 degrees for shipment and for convenient access. The clip, additionally, can hold the spring at a 90 degree orientation relative to the panel to facilitate installation. Besides its role in attaching the suspension spring to the panel, the clip serves to precisely locate the panel on the grid. The locating function of the clip enables the panels to be quickly and precisely installed. As disclosed, the clips can eliminate a horizontal positioning function from the purpose of the springs.

In the preferred embodiment, the clip is a one piece sheet metal stamping having a bent finger that serves as a hinge pin on which is captured a coil of the suspension spring. The finger or hinge pin is disposed between a pair of spaced stops of the clip that restrain the spread of the spring arms extending from the coil. The stops frictionally hold the spring arms in a 90 degree orientation. In this orientation, the spring is most easily grasped for alignment and insertion of the spring arms into receiving slots in the overlying grid runner by an installer or technician.

DESCRIPTION OF THE PREFERRED EMBODIMENT

Figure 1:
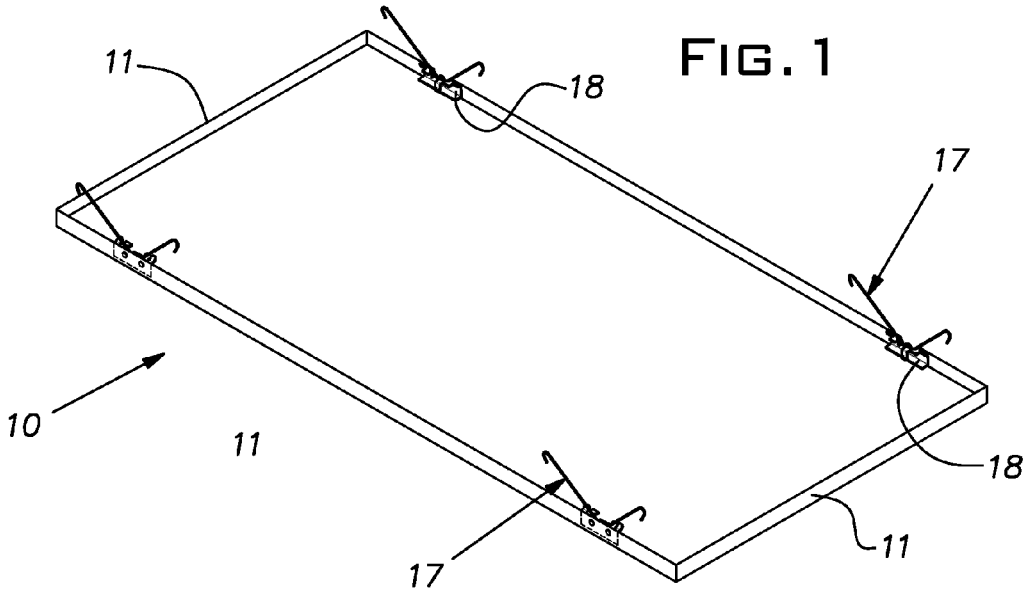
FIG. 1 is a perspective view of a rear face of a ceiling panel for a suspended ceiling.

Referring now to the drawings, a ceiling panel 10 for a suspended ceiling has a rectangular shape which can be square or, as shown in FIG. 1, rectangular. Nominal sizes of the panels include 2 foot×2 foot and 2 foot×4 foot. Dimensions given in this disclosure are intended to include industry metric equivalent dimensions.

The illustrated panel 10 is formed of sheet metal, typically 0.032 inch gauge aluminum, and has its four edges bent upwardly to form generally vertical sidewalls 11. The sidewalls 11, which give the panel 10 the configuration of a shallow pan, can be nominally 1 inch high from the front face of the panel. The sidewalls 11 can be bent slightly more than 90 degrees so that they form an included angle of, for example, 85 degrees with the plane of the panel 10.

Figure 5:
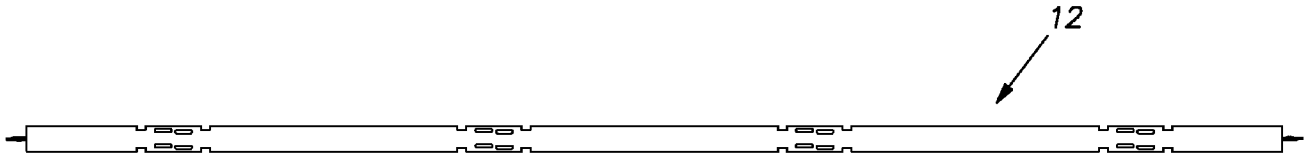
FIG. 5 is a view of a lower face of a flange of a cross runner for use with the panel of FIG. 1.
Figure 6:
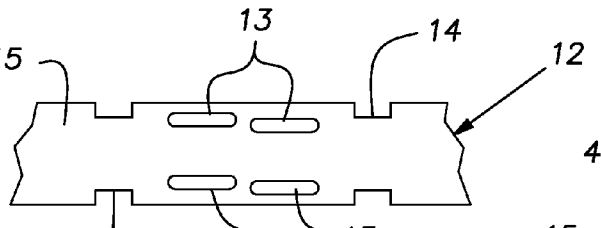
FIG. 6 is an enlarged view of a slotted portion of the flange of FIG. 5.

The panel 10 is used in a conventional manner by attaching it from below to a suspended grid. The grid is typically made from main runners and cross runners, both usually of roll-formed sheet metal with the shape of an inverted tee. Cross runners or tees, nominally 2 foot or 4 foot long and optionally up to 8 foot long, are slotted to receive springs fixed to the panels. A 4 foot cross runner 12 is illustrated in FIG. 5. Details of slots 13, 14 in a flange 15 of the cross runner 12 are illustrated in FIG. 6.

A suspension spring 17 is attached to the panel 10 with a clip 18 of the invention. The clip 18 is preferably formed as a single piece sheet metal stamping. The clip 18 can be made, for example, from 0.047 inch gauge hot dipped galvanized steel. The clip 18 has the general shape of a U-channel with a web 19. The web 19 is generally vertically oriented and extends between lower and upper legs 21, 22. The lower leg 21 of the clip 18 has a notch 23 in a middle of its distal edge. The upper opposite leg 22 is divided into longitudinally spaced zones 26. A strap 27 is cut from respective mid-sections of the upper leg 22 and the web 19. A distal end of the strap 27 is notched on opposite sides leaving a neck 28 dimensioned to be frictionally locked in the notch 23 on the lower leg 21. Mutually facing edges 31 of the zones 26 are spaced a predetermined distance to properly engage an associated suspension spring 17 assembled on the strap 27. The edges 31 are stepped at angled intermediate portions 32 to control positioning of the spring 17.

Each upper leg zone 26 has a raised tab 36, both tabs lying in a common steeply inclined plane such that the tabs are nearly vertical. Each of the tabs 36 are beveled at 37 so that the tops of the tabs are smaller than their widths.

The illustrated springs 17 are of the torsion wire type having a single coil 40 and a pair of divergent arms 41. In the free state of the spring 17, the arms 41 can form an angle between each other of, for example, 135 degrees. The free ends of the arms are bent slightly over 180 degrees to improve retention force and avoids potential interference with slots 14 in the cross runner flange 15.

The width of the strap 27 is sized to be received in the spring coil 40 with sufficient clearance to allow the coil to move along and pivot about the strap. The spring coil 40 is assembled on the strap 27 before the strap is finally assembled with its neck 22 in the notch 23. The strap 27 serves as a hinge pin for the spring 17.

A panel has at least one clip and spring assembly on each of a pair of opposite edges. In the illustrated embodiment, the clips 18 are fixed to the inside of a respective sidewall 11 with pop rivet style fasteners 39. The sidewalls 11 at the clip 18 can be notched for clearance of the spring 17 when the spring is hinged outward of the panel 10.

The cross runner 12 has two pairs of through slots 13 in its lower flange 15 at regular locations corresponding to the locations of the panel clips 18 and springs 17.

Figure 3:
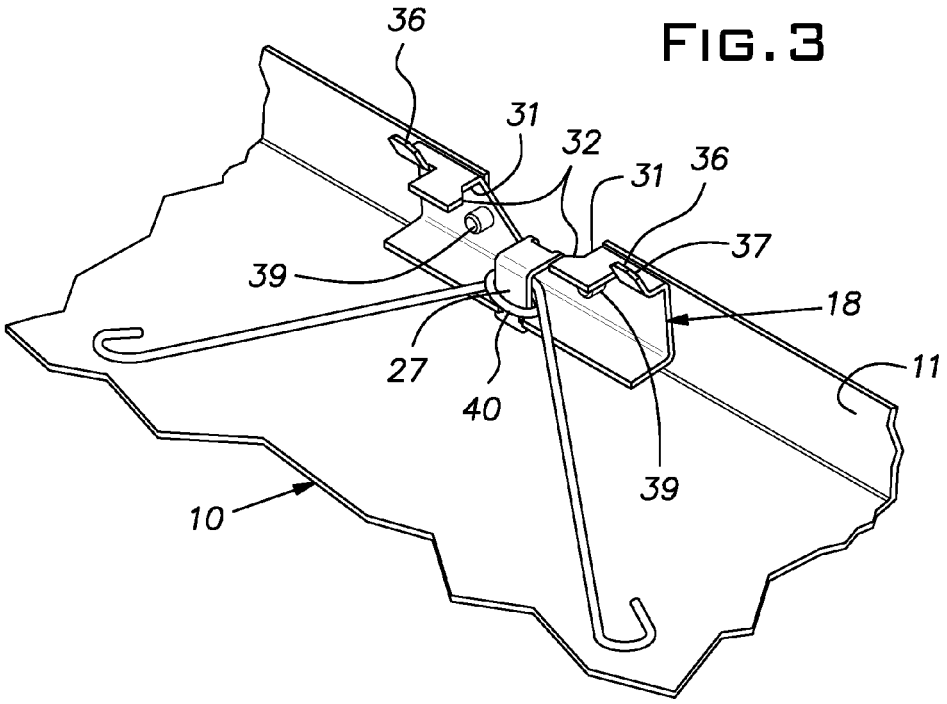
FIG. 3 is a view similar to FIG. 2 showing the spring arms folded onto the panel for storage and shipment.
Figure 4:
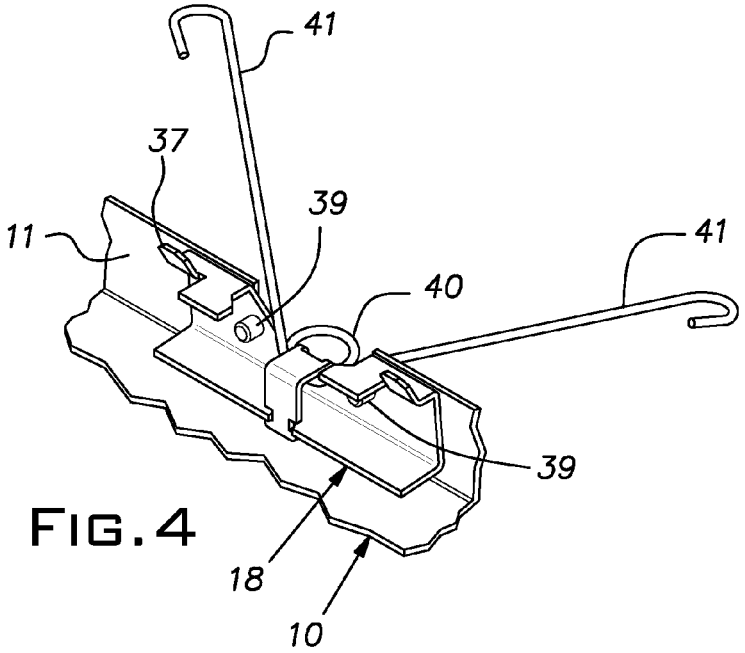
FIG. 4 is a view similar to FIG. 2 with the spring arms folded outward as they are when a panel is suspended from one side.
Figure 7:
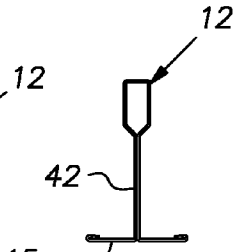
FIG. 7 is a cross-sectional view of the grid runner of FIG. 5.

For example, the locations can be on 1 foot centers or multiples of 1 foot. The slots 13 of a pair on one side of the flange 15, relative to a center of the cross runner 12, represented by a web 42 (FIG. 7), are slightly staggered to account for the offset of the spring arms 41 made by the coil 40. FIG. 3 illustrates a typical spring 17 in a retracted position where it is turned in and overlies a rear face of the panel proper; this position is useful for packaging and shipping of the panel 10.

Figure 2:
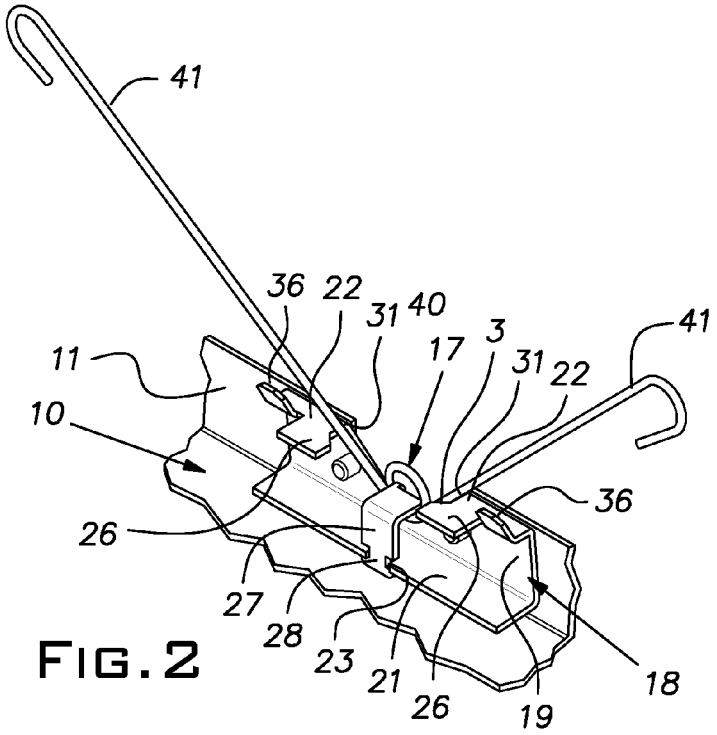
FIG. 2 is a perspective view of an area of the ceiling panel of FIG. 1 on an enlarged scale showing a typical clip and spring assembly of the invention with arms of the spring in a plane at 90 degrees to the plane of the panel.

FIGS. 1 and 2 illustrate a feature of the clip and spring assembly where the stop edges 31 frictionally retain the spring arms 41 in an upright vertical or nearly vertical plane. This function can facilitate installation of the panel 10 since it eliminates compound hand manipulation of the spring 17. To insert the spring arms 41 in an appropriate set of slots 13, the installer need only squeeze the arms together so that they can register with the slots. No major hinging movement of the arms from over the panel 10 or from outside the space of the panel is required.

Another feature of the clip is a precise alignment function provided by the upwardly oriented tabs 36. The tabs 36 index precisely with the cross runner edge slots 14 both longitudinally and laterally of the panel 10. The spring arms 41 are first inserted in their respective slots 13. The tabs 36 will index into the associated open edge grid runner slots or notches 14 under the influence of the vertical upward force developed by the associated spring arms which when disposed in the slots bias the panel upwardly towards the cross runner flange 15. The upward spring force is effective when the panel 10 is near the desired position and is moved along the cross runner 12 to snap the tab 36 into a respective slot 14 thereby properly locating the panel 10 longitudinally on the cross runner 12.

The inclined angle, off the vertical, of the tabs 36 serves to center the panel 10 laterally with respect to the cross runners 12 on opposite sides of the panel as the springs 17 draw the clips 18 towards the cross runners.

Figure 8:
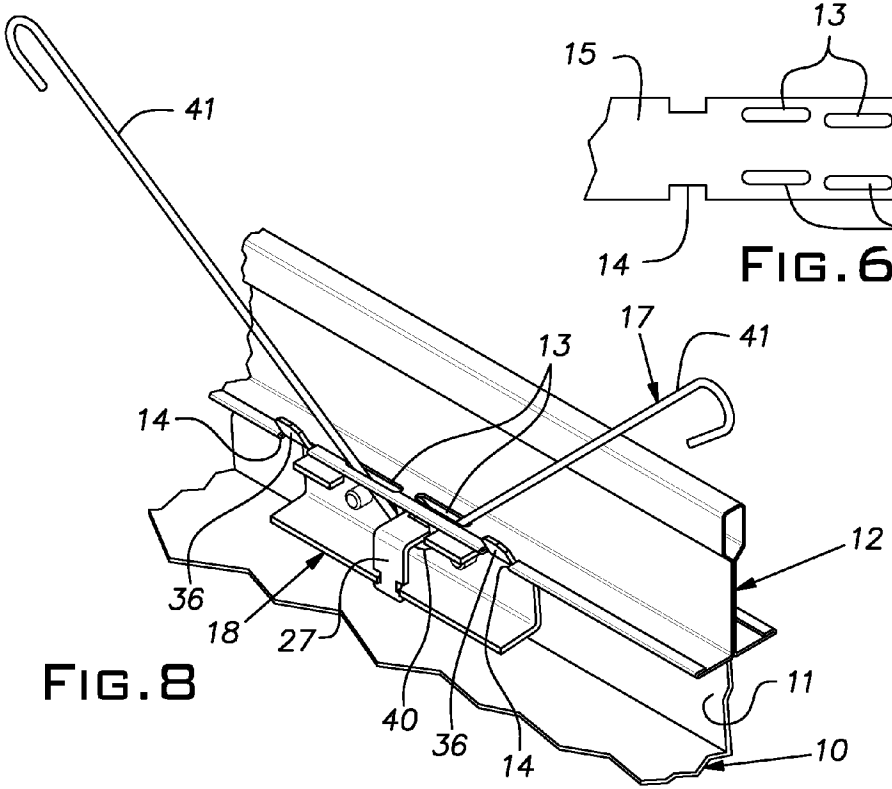
FIG. 8 is a fragmentary perspective view, from above, of the panel installed on a grid runner.

FIG. 8 illustrates a clip and spring assembly of a panel 10 precisely positioned in a final assembly with a cross runner 12. It will be seen that the clip tabs 36 are fully received in the edge slots 14. There is negligible longitudinal clearance in the longitudinal direction of the cross runner 12 between a tab 36 and a slot 14 and essentially no clearance in the lateral direction. The inclination of the tab 36 guides the tab into a slot 14 and the clip is proportioned to locate the tab laterally tightly against the bottom of the slot 14.

From the foregoing, it will be seen that the several clips 18 of a panel 10 are effective to precisely locate the panel both laterally and longitudinally in the horizontal plane of a ceiling grid and that this positioning is independent of the horizontal location of the respective springs 17, it being understood that they are loosely received in the slots 13, and on the strap 27.

Figure 9:
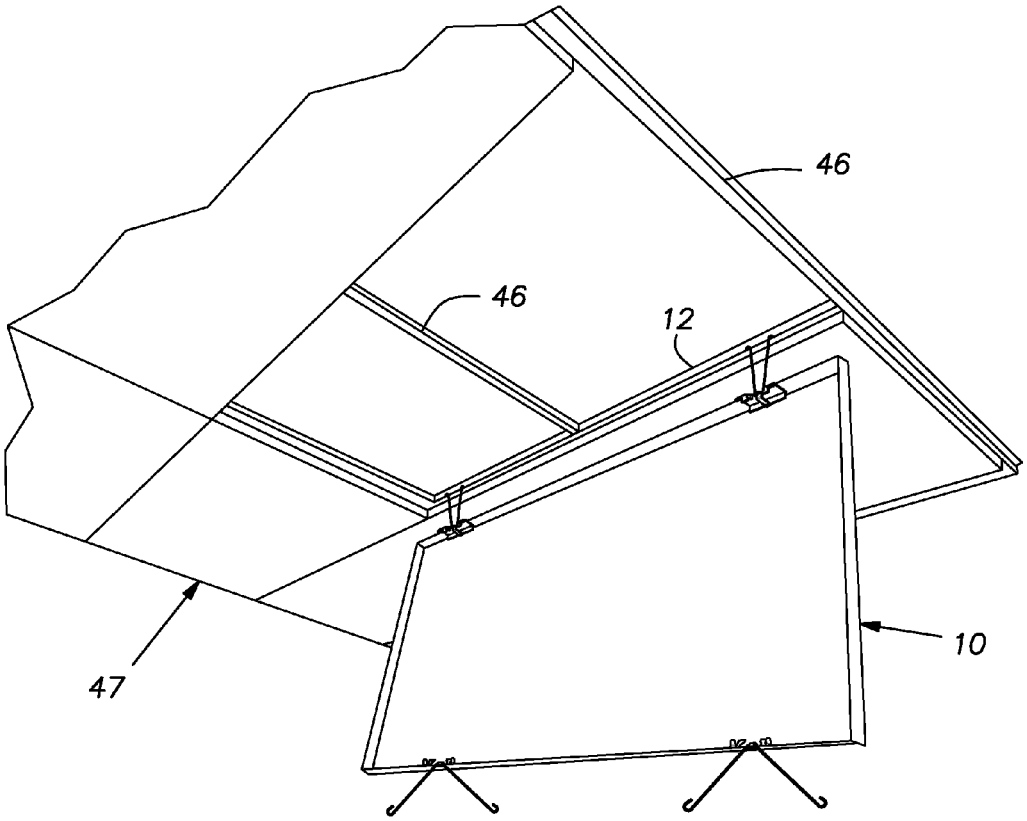
FIG. 9 is a perspective view of the panel of FIG. 1 hanging from one side thereof on a cross runner in a suspended ceiling to permit access to the plenum above the ceiling.

FIG. 9 shows a panel 10 disengaged from a suspended grid 46 at one side of the panel to provide access to the plenum above the suspended ceiling indicated at 47. As shown, the ability of the springs 17 to hinge outside of the footprint of the panel 10 enables the panel to hang down at the side of the space it occupies when installed on the grid 46. This hanging position offers ready access to the plenum and a convenient and relatively safe place to temporarily store the panel 10.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

What is claimed is:

1. A panel for a suspended ceiling, the panel having a rectangular profile in plan view with two pairs of opposed sidewalls having upper edges whereby the panel has a shallow pan configuration, a clip rigidly fixed on the panel at each of two opposed panel edges, a suspension spring with two divergent arms at each of said two opposed panel edges carried on a respective one of said clips, said clips providing locator elements rigidly fixed to the panel and projecting obliquely toward a center of the panel above a topmost of said panel sidewall upper edges, the locator elements having guiding surfaces adapted to bring the panel into registration with external edges of lower flanges of a suspended grid member when the panel is misaligned relative to a suspended grid a small distance in two perpendicular horizontal directions.

2. A panel as set forth in claim 1, wherein said clip locator elements are arranged to laterally guide the panel into registration with a grid member.

3. A panel as set forth in claim 2, wherein the clip locator elements are each arranged to engage an open sided notch in the edge of a grid runner.

4. A panel as set forth in claim 3, wherein the locator elements are each integral with a respective one of said attached clips.

5. A panel as set forth in claim 4, wherein each of said clips forms a strap and the spring is a torsion spring with a central coil assembled on said strap.

6. A panel for a suspended ceiling, the panel having a rectangular profile in plan view with two pairs of opposed sidewalls whereby the panel has a shallow pan configuration, at least one pair of opposed sidewalls having coplanar upper edges, a suspension spring with two divergent arms at each of two opposed panel edges mounted on a rear side of the panel, each spring being mounted on the panel with a sheet metal clip arrangement permitting the arms to lie in a plane generally parallel to a plane defined by a front face of a panel, project rearwardly in a plane generally perpendicular to the front face plane and to lie outside of the panel in a plane substantially parallel to the front face plane, the sheet metal clip arrangement enabling the spring in a stable condition to occupy the rearward projecting orientation utilizing a force developed by the spring with its arms confined towards one another, each sheet metal clip arrangement including a locator element, rigidly fixed relative to the panel and projecting above a topmost of said panel sidewall edges and obliquely toward a center of the panel, adapted to index the panel to external edges of a lower flange of a grid runner of a suspended grid.

7. A panel as set forth in claim 6, wherein said sheet metal clip arrangement is provided by a sheet metal clip stamped from a single piece of sheet metal.

* * * * *